US007936246B2

(12) United States Patent
Hopper et al.

(10) Patent No.: US 7,936,246 B2
(45) Date of Patent: May 3, 2011

(54) ON-CHIP INDUCTOR FOR HIGH CURRENT APPLICATIONS

(75) Inventors: Peter J. Hopper, San Jose, CA (US); Peter Smeys, Mountain View, CA (US); Andrei Papou, San Jose, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 237 days.

(21) Appl. No.: 11/973,536

(22) Filed: Oct. 9, 2007

(65) Prior Publication Data

US 2009/0091414 A1 Apr. 9, 2009

(51) Int. Cl.
*H01F 27/24* (2006.01)

(52) U.S. Cl. ..... 336/212; 336/200; 336/221; 336/223

(58) Field of Classification Search ..... 336/212, 336/200, 221, 223
See application file for complete search history.

(56) References Cited

U.S. PATENT DOCUMENTS

| | | | | |
|---|---|---|---|---|
| 5,155,676 | A * | 10/1992 | Spreen | 363/126 |
| 5,959,522 | A * | 9/1999 | Andrews | 336/200 |
| 6,593,838 | B2 * | 7/2003 | Yue | 336/84 C |
| 7,295,094 | B2 * | 11/2007 | Jitaru et al. | 336/200 |
| 7,688,172 | B2 * | 3/2010 | Lotfi et al. | 336/200 |
| 7,772,955 | B1 * | 8/2010 | Li et al. | 336/200 |
| 2006/0202789 | A1 * | 9/2006 | Hyvonen | 336/200 |

* cited by examiner

*Primary Examiner* — Elvin G Enad
*Assistant Examiner* — Joselito Baisa
(74) *Attorney, Agent, or Firm* — Dergosits & Noah LLP

(57) ABSTRACT

Saturation of nonlinear ferromagnetic core material for on-chip inductors for high current applications is significantly reduced by providing a core design wherein magnetic flux does not form a closed loop, but rather splits into multiple sub-fluxes that are directed to cancel each other. The design enables high on-chip inductance for high current power applications.

12 Claims, 4 Drawing Sheets

ON-CHIP INDUCTOR FOR HIGH CURRENT APPLICATIONS

FIELD OF THE INVENTION

The present invention relates generally to integrated circuit inductor structures and, in particular, to an on-chip inductor design for high current applications that significantly reduces saturation of nonlinear ferromagnetic core material.

DISCUSSION OF THE RELATED ART

The ferromagnetic core elements of micro-fabricated on-chip inductors are currently designed such that the segmented laminations of the core elements provide a closed loop for magnetic flux. The advantage of this closed loop design is that it provides the highest possible inductance at low excitation current. The drawback of this commonly utilized approach is that magnetic flux quickly saturates the magnetic core, causing inductance to drop significantly as current increases.

Many power electronics applications require inductors to carry high currents while also maintaining high inductance values. The core saturation problem becomes even more critical in the case of on-chip inductors because of strict area requirements and the complexity of the fabrication process for these structures.

It would be highly beneficial to those attempting to incorporate inductors into integrated circuits, particularly circuits for hand-held devices such as cell phones and PDAS, to have available a technique for providing high on-chip inductance for high current applications.

SUMMARY OF THE INVENTION

The present invention provides a magnetic core design for on-chip inductor structures in which the saturation of the nonlinear ferromagnetic core material is significantly reduced. This is accomplished by designing the core elements in such a way that the magnetic flux does not form a closed loop, but rather splits into multiple sub-fluxes that are directed to cancel each other. The core element design enables high on-chip inductance for high current applications.

The features and advantages of the various aspects of the present invention will be more fully understood and appreciated upon consideration of the following detailed description of the invention and the accompanying drawings, which set forth illustrative embodiments in which the concepts of the invention are utilized.

DETAILED DESCRIPTION OF THE INVENTION

The present invention provides a design for the ferromagnetic core elements and conducting coil of an on-chip inductor. The magnetic core element design relies upon the principle of inducing magnetic flux in the core laminations to flow in different directions to further cancel each other in the meeting point. Since such a cancellation does not occur abruptly, but rather occupies non-zero volume where the magnitude of the magnetic induction vector decreases gradually, the material of this finite volume of core lamination is saturated at higher current than material in a conventional core lamination, which has a single direction of magnetic flux. The design trade-off for not using a closed loop for magnetic flux in the core material is lower inductance at very low current.

Figure 1A:
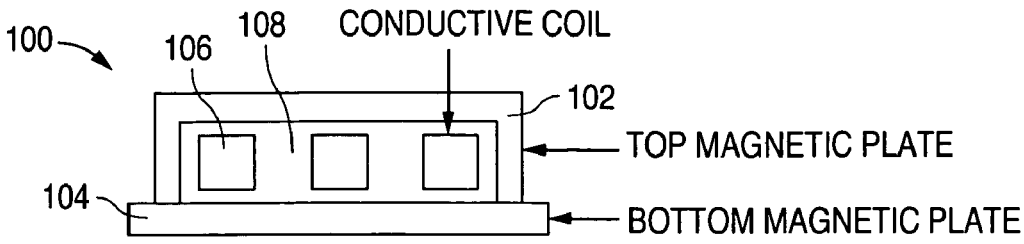
FIGS. 1A and 1B are cross section views illustrating two respective on-chip inductor structures in which the flux cancellation concepts of the present invention may be utilized.
Figure 1B:
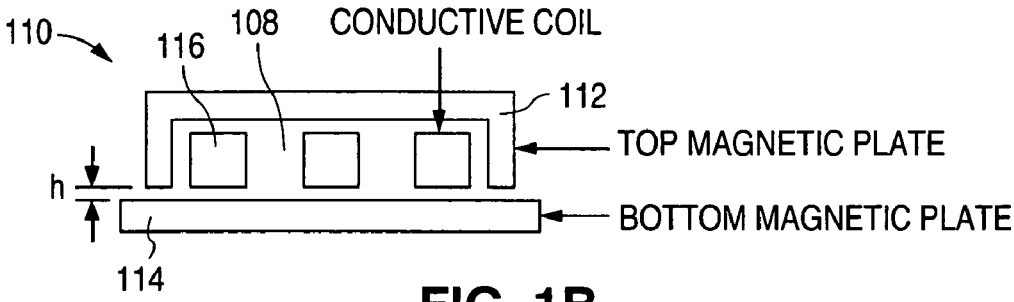

FIGS. 1A and 1B show cross section views of two on-chip inductor structures 100 and 110, respectively, that are compatible with the concepts of the present invention. In the FIG. 1A structure 100, a segmented top magnetic core element 102 and a segmented bottom magnetic core element 104 surround a conductive inductor coil 106 and touch each other. The inductor coil 106 is electrically insulated from both the top core element 102 and the bottom core element 104 by intervening dielectric material 108. Large inductance can be made by the FIG. 1A configuration because reluctance is minimized. In the FIG. 1B inductor structure 110, there is a finite gap (h) between the segmented top magnetic core element 112 and the segmented bottom magnetic core element 114 that surround the inductor coil 116; as in the case of the FIG. 1A structure, the coil 116 is insulated by dielectric material 118. The magnetic path in this case is composed of the magnetic elements 112, 114 and the gap h. The total inductance can be adjusted in this case by changing the height h of the gap. Also, magnetic saturation due to high current levels can be controlled by the gap height h. In both the FIG. 1A and the FIG. 1B structures, the top and bottom core elements can be any ferromagnetic material (e.g., permalloy) and the conductive coil preferably comprises copper.

Figure 2:
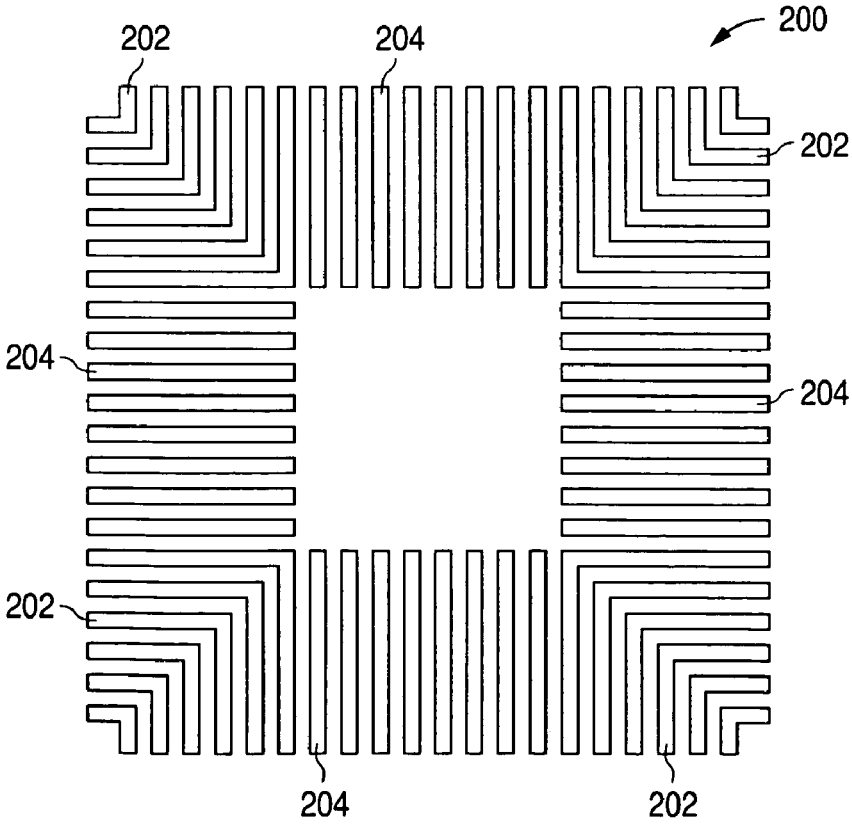
FIG. 2 is a top view illustrating a magnetic core element structure in accordance with the concepts of the present invention.

As discussed above, in accordance with the present invention, the magnetic core elements of the inductor structures shown in FIGS. 1A and 1B are formed such that the magnetic flux in at least some of individual laminations of the segmented core elements flows in different directions to cancel each other in the meeting point. FIG. 2 shows a four-turn square embodiment of a segmented ferromagnetic core element 200 in accordance with the concepts of the present invention shown. All L-shaped ferromagnetic laminations 202 in the four corners of the segmented core element 200 exploit the flux cancellation concepts of the present invention. The remaining laminations 204 provide a closed loop path for magnetic flux around the turns of the conducting coil (not shown).

Figure 3A:
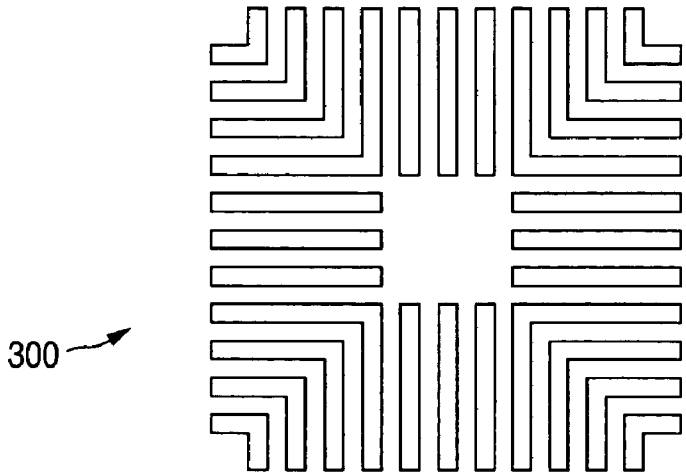
FIGS. 3A-3C are top views illustrating a bottom segmented magnetic core element, a conductive inductor coil and a top segmented magnetic core element, respectively, in accordance with the concepts of the present invention.
Figure 3B:
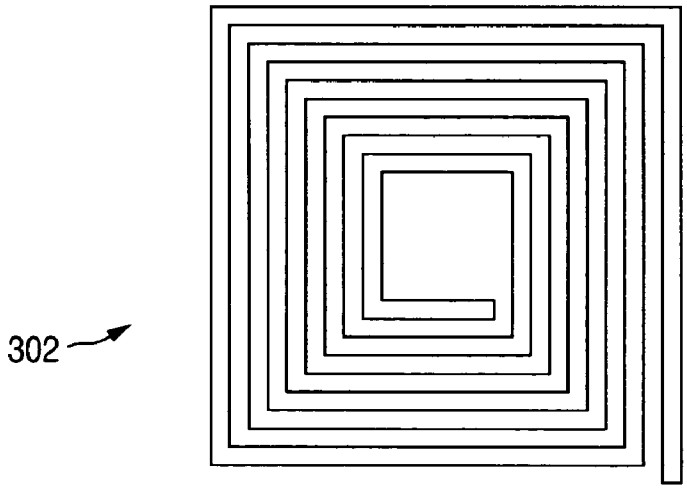
Figure 3C:
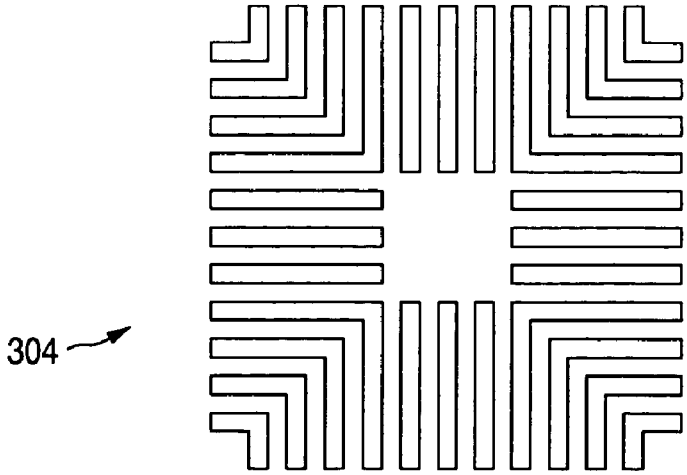

FIGS. 3A-3C show top views of embodiments of segmented magnetic core elements and a conductive coil that are consistent with the inductor structures shown in FIGS. 1A and 1B and in accordance with the concepts of the present invention. FIG. 3A shows a top view of an embodiment of a bottom four-turn square magnetic core element 300 in accordance with the invention. FIG. 3B shows a top view of an embodiment of a conductive inductor coil 302. FIG. 3C shows a top view of an embodiment of a top four-turn square magnetic core element 304 in accordance with the invention.

Figure 4:
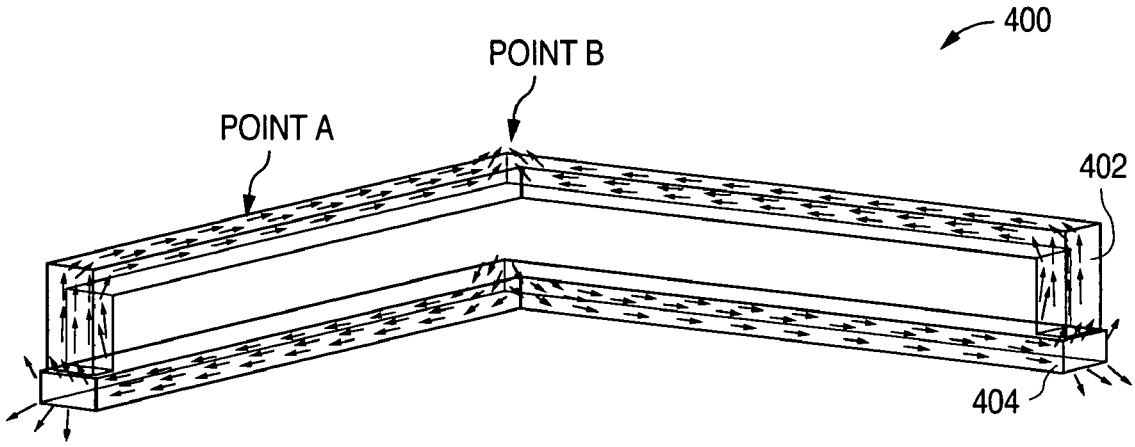
FIG. 4 is a perspective drawing showing a simulated magnetic flux distribution in one L-shaped corner lamination of the FIG. 2 magnetic core element structure under high current excitation.

FIG. 4 shows simulated magnetic flux distribution in an L-shaped corner lamination 400 under high current conditions. Those skilled in the art will appreciate that the top lamination 402 and the bottom lamination 404 are shown in FIG. 4, but the inductor coil is not. The dark shading (e.g. Point A) in FIG. 4 means that the ferromagnetic core material is saturated (e.g., S{I }=1.00667c+00 to 1.0007c+00) at that particular point. The non-zero volume of the unsaturated (e.g., S{I}=1.4209c−01 to 1.0000c−02) core material is also shown by lighter shading (e.g., Point B).

Figure 5:
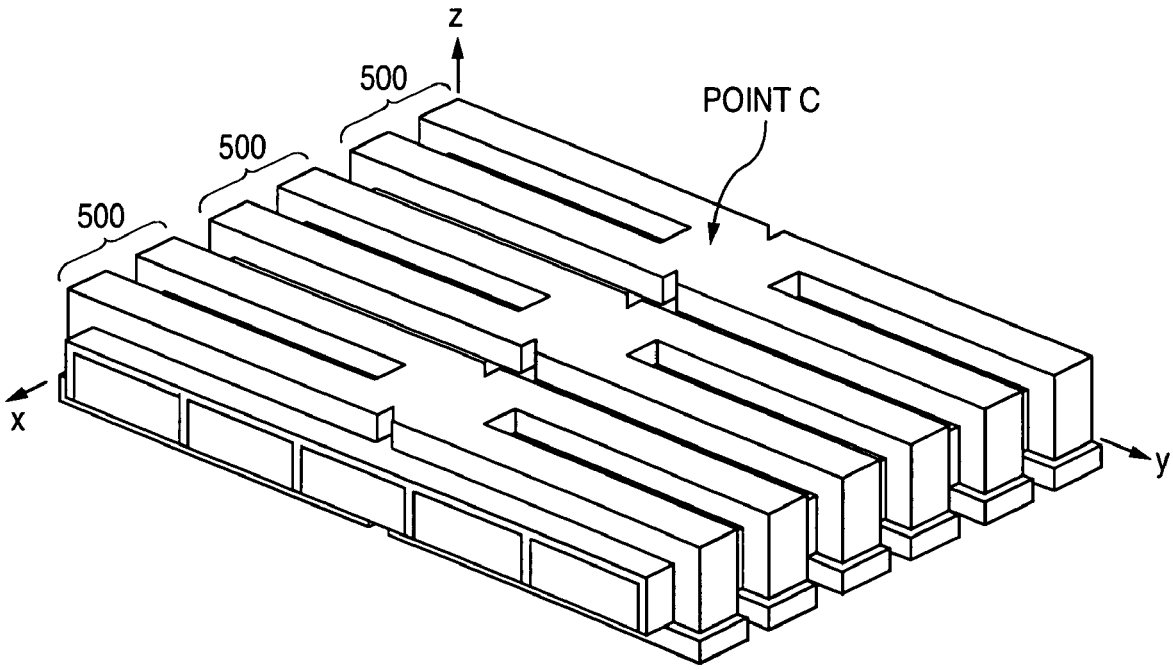
FIG. 5 shows an embodiment of alternate lamination design as a replacement for the standard closed loop laminations in the FIG. 2 structure, in accordance with the concepts of the present invention.

As shown in FIG. 5, the standard closed loop laminations 204 of the FIG. 2 four-turn square core element structure 200 can be replaced by, for example, dual U-shaped ferromagnetic lamination structures 500 that take advantage of the flux cancellation concepts of the present invention. Those skilled in the art will appreciate that the non-zero volume of the unsaturated magnetic core material will occur in the region of the meeting point (Point C) of the laminations 500 in the FIG. 5 embodiment. Those skilled in the art will also appreciate that other flux cancellation designs are also utilizable and within the scope of the present invention.

Figure 6:
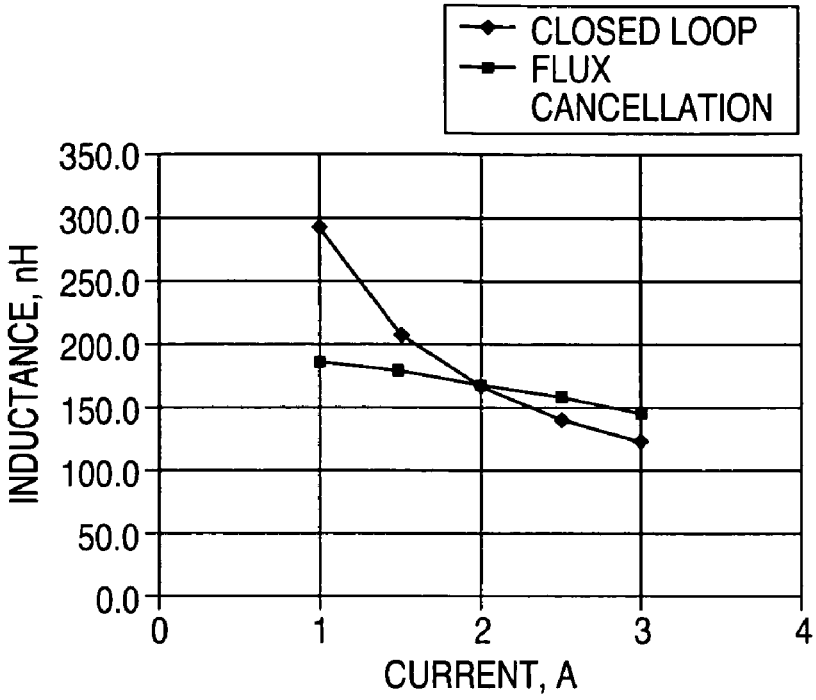
FIG. 6 provides saturation curves for a conventional closed loop four-turn square lamination inductor structure and for a four-turn square lamination inductor structure in accordance with the concepts of the present invention.

FIG. 6 shows saturation curves for two different structures of a four-turn square inductor: one structure utilizes the conventional closed loop lamination design while the other structure utilizes flux cancellation laminations of the type discussed above in accordance with the invention. Both inductors use the same ferromagnetic core material and occupy the same area on a chip. As can be seen from FIG. 6, the inductance of the inductor that utilizes flux cancellations laminations in accordance with the concepts of the invention is larger at higher currents.

Since the magnetic field is smaller in the vicinity of the cancellation area, the techniques of the present invention induce less eddy currents than the standard closed loop lamination, thereby improving the high frequency behavior of on-chip inductors that incorporate these concepts.

Figure 7:
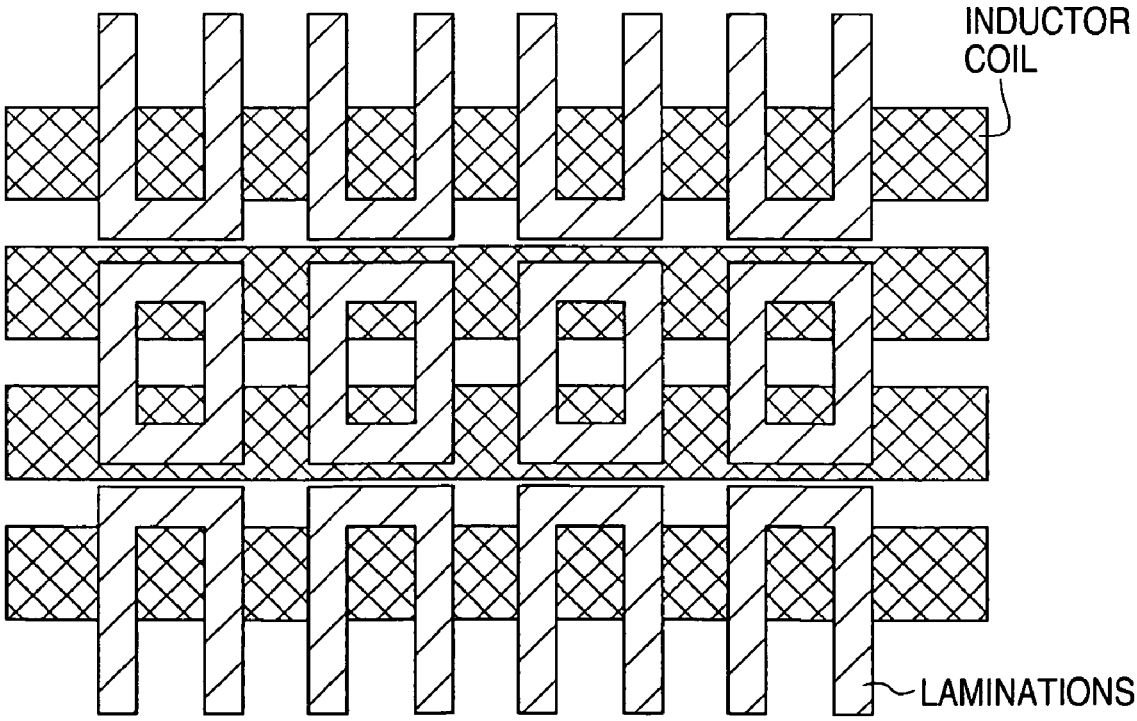
FIG. 7 provides a top view of an embodiment of a lamination structure for a segmented magnetic core element in accordance with the concepts of the present invention.

A more advanced embodiment of a flux cancellation lamination structure in accordance with the invention is shown in FIG. 7, wherein a top view of the laminations is provided. A bottom view of the laminations is similar.

It should be understood that the particular embodiments of the invention described above have been provided by way of example and that other modifications may occur to those skilled in the art without departing from the scope and spirit of the invention as expressed in the appended claims and their equivalents.

What is claimed is:

1. A magnetic core element of an integrated circuit inductor structure, the magnetic core element comprising:

a bottom segmented magnetic core element that includes a plurality of spaced-apart bottom element laminations, each bottom element lamination having a first edge that is parallel to an edge of a first adjacent bottom element lamination and a second edge that is parallel to an edge of a second adjacent bottom element lamination; and a top segmented magnetic core element that includes a plurality of spaced-apart top element laminations, each top element lamination having a first edge that is parallel to an edge of a first adjacent top element lamination and a second edge that is parallel to an edge of a second adjacent top element lamination, the bottom and top segmented magnetic core elements being disposed with respect to each other so as to surround a conductive inductor coil that is separated from the bottom and top magnetic core elements by intervening dielectric material, wherein at least one bottom element lamination combines with a corresponding top element lamination to provide a magnetic core lamination in which at least a portion of the magnetic fluxes that flow in the magnetic core lamination when a current is passed through the inductor coil cancel each other.

2. A magnetic core element as in claim 1, and wherein the magnetic core lamination is L-shaped.

3. A magnetic core element as in claim 1, and wherein the magnetic core lamination is dual U-shaped.

4. A magnetic core element as in claim 1, and wherein the magnetic core element comprises a ferromagnetic material.

5. A magnetic core element as in claim 4, and wherein the ferromagnetic material comprises permalloy.

6. A magnetic core element as in claim 4, and wherein the inductor coil comprises copper.

7. A rectangular integrated circuit inductor structure comprising:

a conductive inductor coil;

a rectangular bottom magnetic core element that includes a plurality of space-apart bottom element laminations, each bottom element lamination having a first edge that is parallel to an edge of a first adjacent bottom element lamination and a second edge that is parallel to an edge of a second adjacent bottom element lamination, the bottom element laminations including at least one L-shaped bottom element lamination formed at each corner of the rectangular bottom magnetic core element;

a top rectangular magnetic core element that includes a plurality of space-apart top element laminations, each top element lamination having a first edge that is parallel to an edge of a first adjacent top element lamination and a second edge that is parallel to an edge of a second adjacent top element lamination, the top element laminations including at least one L-shaped top element lamination formed at each corner of the rectangular top magnetic core element, the top magnetic core element being disposed with respect to the bottom magnetic core element to surround the conductive inductor coil, the conductive inductor coil being separated from the top and bottom magnetic core elements by intervening dielectric material, wherein the L-shaped top element lamination at each corner of the top rectangular magnetic core element combines with a corresponding L-shaped bottom element lamination to provide an L-shaped magnetic core lamination at each corner of the rectangular integrated circuit inductor structure.

8. A rectangular integrated circuit inductor structure as in claim 7, and wherein the rectangular integrated circuit inductor structure is a square structure.

9. A rectangular integrated circuit inductor structure as in claim 7, and wherein a plurality of L-shaped magnetic core laminations are formed at each corner of the rectangular integrated circuit inductor structure.

10. A rectangular integrated circuit inductor structure as in claim 7, and wherein at least one closed loop magnetic core lamination is formed between adjacent corners of the rectangular integrated circuit inductor structure.

11. A rectangular integrated circuit inductor structure as in claim 7, and wherein at least one flux cancellation magnetic core lamination is formed between adjacent corners of the rectangular integrated circuit inductor structure.

12. A method of forming a magnetic core element of an inductor structure, the method comprising:

forming a bottom segmented magnetic core element that includes a plurality of space-apart bottom element laminations, wherein each bottom element lamination has a first edge that is parallel to an edge of a first adjacent bottom element lamination and a second edge that is parallel to an edge of a second adjacent bottom element lamination;

forming a conductive inductor coil over the bottom segmented magnetic core element, the conductive inductor coil being separated from the bottom segmented magnetic core element by intervening dielectric material;

forming a top segmented magnetic core element over the conductive inductor coil and separated therefrom by intervening dielectric material, the top segmented magnetic core element including a plurality of spaced-apart top element laminations, wherein each top element lamination has a first edge that is parallel to an edge of a first adjacent top element lamination and a second edge that is parallel to an edge of a second adjacent top element lamination, the bottom and top magnetic core elements being disposed with respect to each other to surround the conductive inductor coil and such that at least one bottom element lamination combines with a corresponding top element lamination to provide a magnetic core lamination in which at least a portion of the magnetic fluxes that flow in the magnetic core lamination when a current is passed through the conductive inductor coil cancel each other.

* * * * *